United States Patent [19]

Hwang et al.

[11] Patent Number: 5,000,822

[45] Date of Patent: Mar. 19, 1991

[54] PROCESS FOR THE PREPARATION OF IMITATION LEATHER FROM NATURAL HEMP AND THE PRODUCT THEREOF

[75] Inventors: Tae S. Hwang, Joogong Apt. 210-207, Kaekeum 3-Dong, Pusanjin-ku, Pusan; Kyung H. Kim, Pusan, both of Rep. of Korea

[73] Assignees: Tae S. Hwang, Pusanjin-ku; Young K. Hong, Pusan, both of Rep. of Korea

[21] Appl. No.: 370,770

[22] Filed: Jun. 23, 1989

[30] Foreign Application Priority Data

Jun. 25, 1988 [KR] Rep. of Korea ..... 88-7724
Jun. 14, 1989 [KR] Rep. of Korea ..... 89-8193

[51] Int. Cl.[5] ..... D21C 7/00; D21C 9/00

[52] U.S. Cl. ..... 162/13; 162/9; 162/10; 162/98; 162/148; 162/90; 162/81; 264/115; 264/128

[58] Field of Search ..... 264/115, 128; 162/98, 162/9, 148, 10, 13, 63, 81, 90, 80, 135, 158

[56] References Cited

U.S. PATENT DOCUMENTS

| | | | |
|---|---|---|---|
| 1,944,907 | 1/1934 | McCormic et al. | 162/9 X |
| 2,029,310 | 2/1936 | Drewsen | 162/98 X |
| 2,060,253 | 11/1936 | Shopneck | 162/148 X |
| 2,237,235 | 4/1941 | Lynam | 162/148 X |
| 2,530,244 | 11/1950 | Jensen | 162/98 X |
| 2,615,883 | 10/1952 | Sweeney et al. | 162/81 X |
| 2,651,571 | 9/1953 | Van Dyk | 162/98 X |
| 2,676,885 | 4/1954 | Hamburg | 162/10 |
| 4,036,679 | 7/1977 | Back et al. | 162/9 |
| 4,045,279 | 8/1977 | Nagano et al. | 162/90 X |

*Primary Examiner*—David A. Simmons
*Assistant Examiner*—J. Sells
*Attorney, Agent, or Firm*—Birch, Stewart, Kolasch & Birch

[57] ABSTRACT

An imitation leather product and a process for the preparation of the imitation leather product from natural hemp which comprises the steps of (a) firstly digesting natural hemp fiber with weak alkali solution, (b) secondly digesting with ammonia gas, (c) presoak treating either with methylol urea and ammonium phosphate, or sodium chromate and sulfuric acid, and immediately adding ammonia thereto, respectively, (d) beating with SBR resin and cyclohexylcarboxyl diphenylamino thiazolyl sulfonamide, (e) jetting through a multiple stage fiber jetting device, and soaking in a soaking bath container containing methylphenol and SBR resin.

10 Claims, 3 Drawing Sheets

PROCESS FOR THE PREPARATION OF IMITATION LEATHER FROM NATURAL HEMP AND THE PRODUCT THEREOF

BACKGROUND OF THE INVENTION

1. Field of the Invention

The present invention relates to a process for manufacturing imitation leather from natural hemp and the product thereof and more particularly, to a method for producing imitation leather sheet having an excellent stiffness, flexibility, and hydroscopic property, which is very similar to natural leather.

2. Description of the Prior Art

Various types of conventional synthetic leather are well known in the art. Such synthetic leathers can be classified as follows: (1) imitation leather having a simple structure manufactured by attaching an external surface of polyvinylchloride to a supporting layer such as textile fabric, fabric pieces, paper, and the like; (2) imitation leather manufactured by attaching a final finishing layer to a high molecular polymer such as polyvinylchloride, polyamide, polyurethane polyacrylate, a polyamino acid blend, and the like to an external surface layer corresponding to hidden surface layer of natural leather on a supporting layer of textile fabric, fabric pieces, and the like; and (3) imitation leather having multiple layers with a double layered textile layer, that is, a basic layer formed with non-woven fabric and a polymer binder, and a surface layer formed with a porous layer, or relatively thin polymer layer, and an additional textile layer formed by using a plurality of head boxes, which are containers which continuously feed the textile pulp to the sheet forming mechanisms. Although such imitation leather generally is similar to natural leather, it has insufficient stiffness, flexibility, and hygroscopic properties. Furthermore, the various layers of such imitation leather may disadvantageously separate from each other during use.

Recently, some forms of imitation leather have been improved by mixing polymeric material with paper pulp such as craft pulp mixed with "Linter" obtained from cotton seeds. However, the "Linter" is expensive so that the cost of the product is increased and it is complicated to manufacture.

Furthermore, such prior art imitation leather is formed by utilizing a plurality of head boxes to produce a layer form in a process requiring the layer material to pass through respective head boxes. Therefore, there are many problems such as an increase in inferiority and in the separation of layers, as well as a requirement for a plurality of head boxes.

SUMMARY OF THE INVENTION

Accordingly, it is an object of the present invention to provide a method for manufacturing imitation leather from natural hemp of Cannabis sativa L such as yellow hemp, flex hemp, sesame, and the like, and the product thereof.

Another object of the present invention is to provide a process for producing synthetic leather having an excellent stiffness, flexibility, and hydroscopic properties.

A further object of the present invention is to provide a process for producing synthetic leather which comprises using hemp fiber which includes scrap of yellow hemp and natural vegetable cellulose obtained by improving cellulose protoplasm of the hemp.

Still another object of the present invention is to provide imitation leather which is inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an imitation leather product and a process for the preparation of the imitation leather product from natural hemp which comprises the steps of (a) firstly digesting natural hemp fiber with a weak alkali solution, (b) secondly digesting the product of step (a) with ammonia gas, (c) presoak treating the product of step (b) either with methylol urea and ammonium phosphate, or sodium chromate and sulfuric acid, and immediately adding ammonia thereto, respectively, (d) beating the product of step (c) with SBR resin and cyclohexylcarboxyl diphenylamino thiazolyl sulfonamide, (e) jetting the product of step (d) through a multiple stage fiber jetting device, and soaking in a soaking bath container containing methylphenol and SBR resin.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
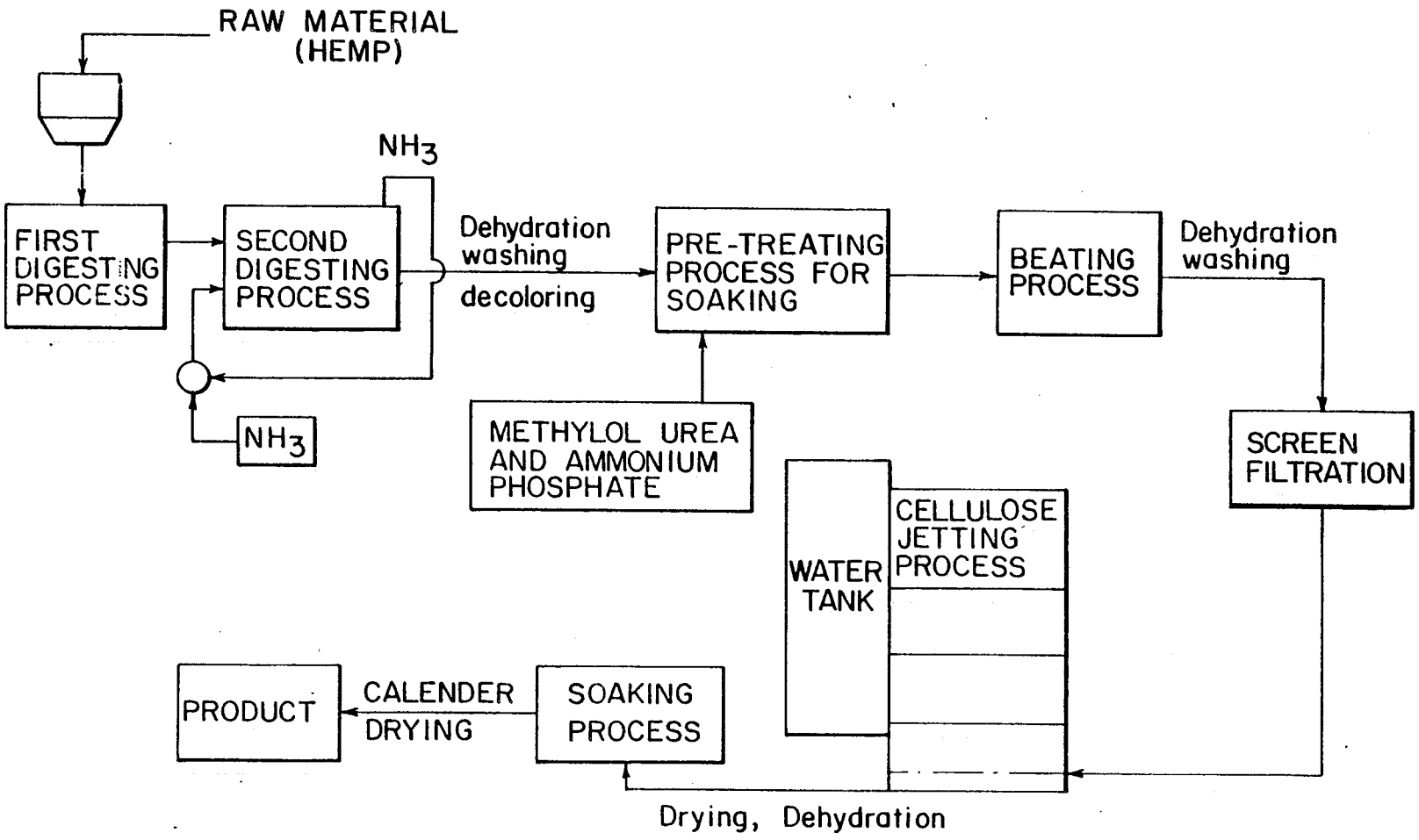
FIG. 1 illustrates steps for producing the imitation leather according to the present invention.
Figure 2:
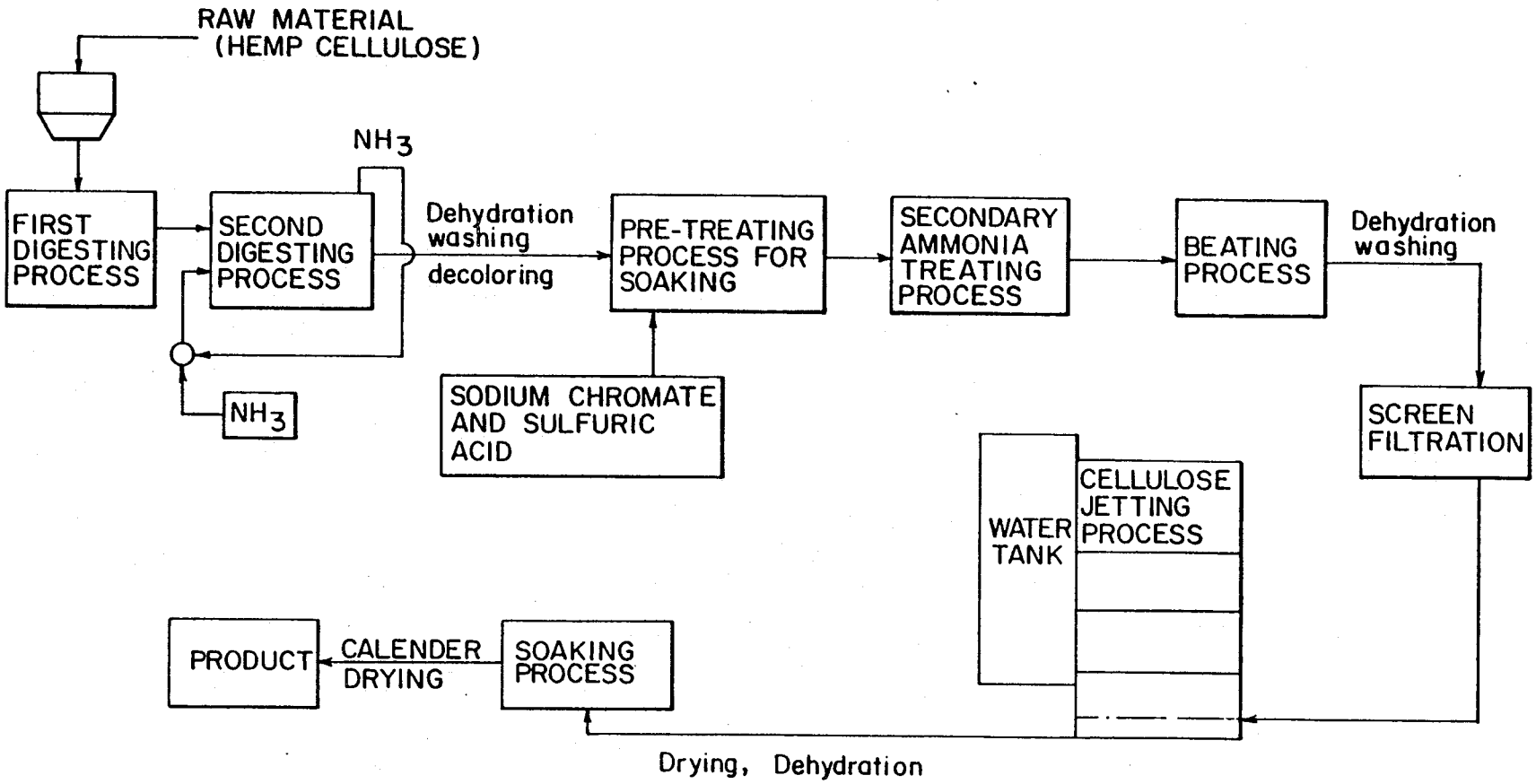
FIG. 2 illustrates another embodiment of steps for producing imitation leather according to the present invention.

Referring now in detail to the drawings for the purpose of illustrating preferred embodiments of the present invention, there is provided with the imitation leather and the process for the preparation of the imitation leather from natural hemp. The process of the present invention as shown in FIGS. 1 and 2 comprises the steps of (a) a first digesting process, (b) a second digesting process, (c) a pretreating process for soaking, (d) a beating process, (e) a jetting process, and (f) a soaking process as follows:

(a) First digesting process

Ground natural hemp fiber is selected through a sieve and left in a first digesting reactor for 24 hours in weak alkali such as a sodium bicarbonate solution with a pH of about 10–11 at room temperature. Crude fat, crude protein, and the like contained in the hemp fiber are dissolved and decomposed by the alkali solution and separated therefrom. Therefore, the hemp fiber is treated so as to be softened.

(b) Second digesting process

The softened hemp fiber of step (a), which are produced by the first digesting process is washed with water for removing the alkali. Thereafter, the washed hemp fiber is put into a second digesting reactor and treated with diluted ammonia gas at a concentration of about 5-15% at a pressure of about 30 kg/cm$^2$ and a temperature of about −35° to 5° C. for about 20 hours.

Figure 3A:
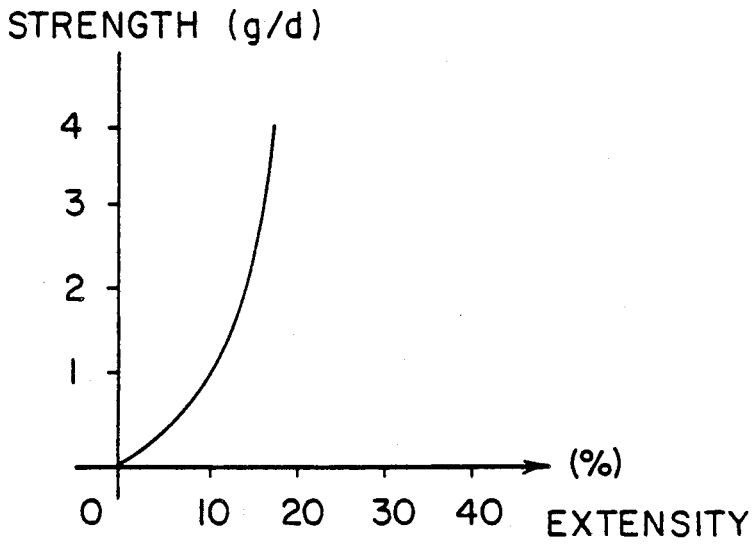
FIG. 3 illustrates graphs showing results obtained from digesting processes according to the present invention.
Figure 3B:
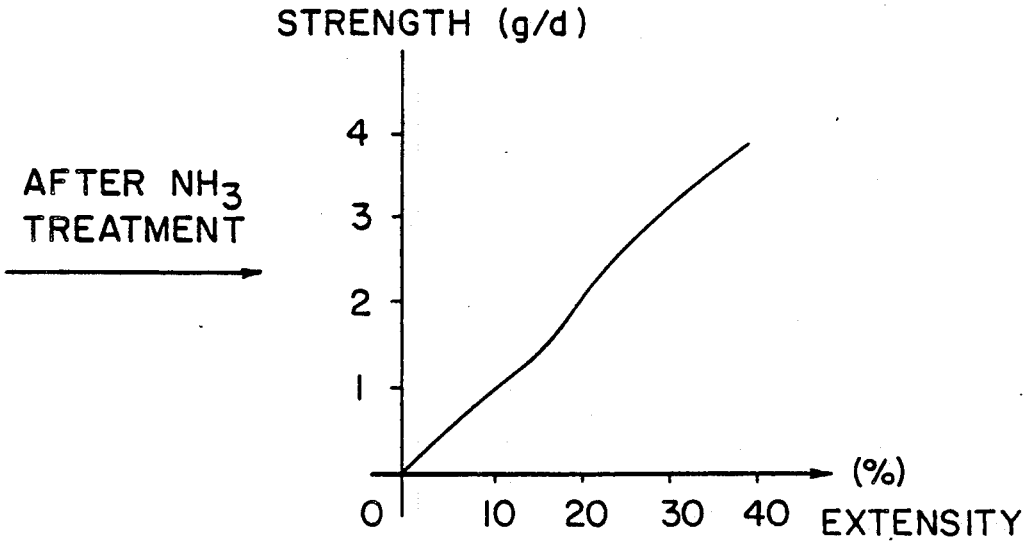

In this process, ammonia is reacted so as to soften the hemp fiber for increasing the strength and extensity thereof as shown in FIG. 3.

(c) Pretreating process for soaking

When the second digesting process of step (b) is finished, the pressure in second digesting reactor is adjusted so as to be equal to atmospheric pressure. Thereafter, as shown in FIG. 1, about 5-10% by volume of methylol urea ($H_2N—CO—NH—CH_2OH$) and about 0.5-3% by volume of ammonium phosphate are put into the second digesting reactor at a temperature of about 105°-160° C. for about 12-2 hours.

Referring in detail to FIG. 2, there is illustrated an additional embodiment of the process in accordance with the present invention. About 0.5-3% by volume of sodium chromate and about 0.5-3% by volume of sulfuric acid are put into the second digesting reactor at a temperature of about 35°-40° C. for about 1-2 hours. Thereafter, ammonia having about 5-10% concentration is mixed with the treated mixture, respectively so as to adhere with amino radical to the hemp fiber. Therefore, the obtained product has the same structure and properties of the conventional protein fiber.

(d) Beating process

The hemp fiber obtained from the pretreating process of step (c) is washed with water, dehydrated, and put into a third reactor, Hollander. The treated hemp fiber is purified by adding about 15% by volume of SBR resin used in water treating and chemical process applications and about 0.5% by volume of cyclohexylcarboxyl diphenylamino thiazolyl sulfonamide of the following formula (1).

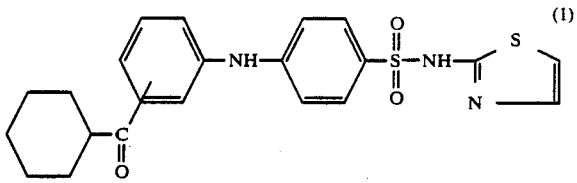

At this time, the hemp fiber is coated with the SBR resin. In sequence, the hemp fiber coated with SBR is separated by filtering with a predetermined size screen and then transferred to the jetting process of step (e).

(e) Jetting process

The hemp fiber transferred from the beating process of step (d) is formed into a sheet of a desired thickness by utilizing a head boxer which is a multiple stage fiber jetting device utilizing water pressure. The sheet is passed through a high pressure roller to manufacture a non-woven sheet.

(f) soaking process

The non-woven sheet of hemp fiber manufactured from the jetting process of step (e) is passed through a soaking bath which contains about 10-35% by volume of methylphenol and about 30% by volume of SBR resin and a pH of about 7-7.5 so as to sufficiently soak with SBR resin, and is thereafter dried. The dried sheet is passed through a conventional calender so as to produce a smooth surface thereon.

A comparison of the imitation leather sheet of the hemp fiber manufacture by the process according to the present invention with a conventional imitation leather sheet is provided in Table 1 as follows:

TABLE 1

Comparison of imitation leather properties of the present invention with that of conventional product

| Leather properties | Conventional Product | Product of the present invention |
|---|---|---|
| tensile strength (kg/cm$^2$) | lateral: 143 | 143 |
| | longitudinal: 196 | 220 |
| tearing strength (kg/cm$^2$) | lateral: 24 | 60 |
| | longitudinal: 28 | 73 |
| rupturing strength (kg/cm$^2$) | 10.1 | 33.5 |
| anti-bending capacity (times) | lateral: 5,000 | 4,900 |
| | longitudinal: 5,000 | 5,000 |

As shown above in Table 1, the imitation leather sheet obtained from the present invention exhibits improved properties over the conventional product. Furthermore, it is easy to supply natural hemp as a raw material including scraps of hemp since the hemp is perennial herb which is possible to obtain in almost all regions in the world. Furthermore, the process according to the present invention employs a multiple stage type cellulose jetting device as compared to the use of a plurality of head boxes required by prior art processes. Therefore, facility space and cost are decreased, and the inferiority is decreased by means of the piling process which can uniformly control the thickness of the product.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A process for preparing imitation leather sheet comprising steps of:

(a) firstly digesting ground natural hemp fiber with a weak alkali solution of a pH of about 10-11 at room temperature for 24 hours, (b) secondly removing the alkali from said first digested hemp fiber produced by step (a) and digesting with ammonia gas at a temperature of about −35° to 5° C. and a pressure of 30 kg/cm$^2$ for 20 hours, (c) presoak treating the ammonia treated hemp fiber produced by step (b) with about 5-10% by volume of methylol urea ($H_2N—CO—NH—CH_2OH$) and about 0.5-3% by volume of ammonium phosphate at a temperature of about 105°-160° C. for about 1-2 hours, thereafter immediately adding about 5-10% by volume of ammonia, (d) heating the treated hemp fiber produced by step (c) with SBR resin and cyclohexylcarboxyl diphenylamino thiazolyl sulfonamide of the following formula (1),

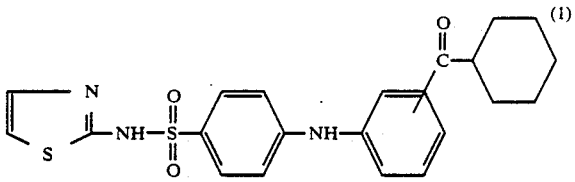

(1)

(e) jetting the beated hemp fiber produced by step (d) through a multiple stage fiber jetting device to produce a non-woven sheet, and (f) soaking the non-woven sheet of step (d) in a soaking bath containing about 10–35% by volume of methylphenol and about 30% by volume SBR resin and having a pH of about 7–7.5.

2. The process of claim 1, wherein the weak alkali in step (a) is sodium bicarbonate.

3. The process of claim 1, wherein the ammonia gas in step (b) is at a 5–15% concentration.

4. The process of claim 1, wherein the SBR resin and the cyclohexylcarboxyl diphenylamino thiazolyl sulfonamide in step (d) are present in an amount of 15% by volume and 0.5% by volume, respectively.

5. Imitation leather produced by the process of claim 1, said imitation leather having an excellent stiffness, flexibility, and hydroscopic properties.

6. A process for preparing imitation leather sheet comprising steps of:

(a) firstly digesting ground natural hemp fiber with a weak alkali solution of a pH of about 10–11 at room temperature for 24 hours, (b) secondly removing the alkali from said first digested hemp fiber produced by step (a) and digesting with ammonia gas at a temperature of about −35° to 5° C. and a pressure of 30 kg/cm$^2$ for 20 hours, (c) removing the alkali from said first digested hemp fiber produced by step (b) and presoak treating with about 0.5–3% by volume of sodium chromate and about 0.5–3% by volume of sulfuric acid at a temperature of about 34°–40° C. for 1–2 hours, (d) heating the presoak treated hemp fiber produced by step (c) with SBR resin and cyclohexylcarboxyl diphenylamino thiazolyl sulfonamide of the following formula (1),

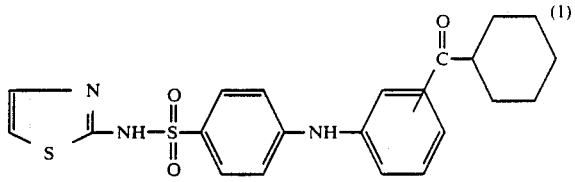

(1)

(e) jetting the beated hemp fiber produced by step (d) through a multiple stage fiber jetting device to produce a non-woven sheet, and (f) soaking said non-woven sheet of step (d) in a soaking bath containing about 10–35% by volume of methylphenol and about 30% by volume SBR resin and having a pH of about 7–7.5.

7. The process of claim 6, wherein the weak alkali in step (a) is sodium bicarbonate.

8. The process of claim 6, wherein the ammonia gas in step (b) is at a 5–15% concentration.

9. The process of claim 6, wherein the SBR resin and the cyclohexylcarboxyl diphenylamino thiazolyl sulfonamide in step (d) have an amount of 15% by volume and 0.5% by volume, respectively.

10. Imitation leather produced by the process of claim 6, said imitation leather having an excellent stiffness, flexibility, and hydroscopic properties.

* * * * *